US010779581B2

(12) United States Patent
Molina

(10) Patent No.: US 10,779,581 B2
(45) Date of Patent: Sep. 22, 2020

(54) PIN ASSEMBLY ATTACHMENT MEMBER AND VERSATILE METHOD OF USE

(76) Inventor: Carmen Luz Molina, Palm Beach Gardens, FL (US)

( * ) Notice: Subject to any disclaimer, the term of this patent is extended or adjusted under 35 U.S.C. 154(b) by 964 days.

(21) Appl. No.: 13/988,266

(22) PCT Filed: Sep. 15, 2011

(86) PCT No.: PCT/US2011/051780

§ 371 (c)(1),
(2), (4) Date: Aug. 14, 2013

(87) PCT Pub. No.: WO2012/040034

PCT Pub. Date: Mar. 29, 2012

(65) Prior Publication Data

US 2014/0024290 A1 Jan. 23, 2014

Related U.S. Application Data

(60) Provisional application No. 61/403,698, filed on Sep. 20, 2010.

(51) Int. Cl.

| | |
|---|---|
| ***A41C 3/00*** | (2006.01) |
| ***A41F 15/00*** | (2006.01) |
| ***A41C 3/12*** | (2006.01) |

(52) U.S. Cl.
CPC ..... *A41C 3/00* (2013.01); *A41F 15/002* (2013.01); *A41C 3/12* (2013.01)

(58) Field of Classification Search
CPC ..... A41F 1/006; A41B 9/16; Y10T 24/3476; A41C 3/12; A41C 3/00
(Continued)

(56) References Cited

U.S. PATENT DOCUMENTS 175,821 A * 4/1876 Clawson ..... G02C 11/00 24/3.3
621,913 A * 3/1899 Feeser ..... A41D 25/00 24/53

(Continued)

FOREIGN PATENT DOCUMENTS

GB 239056 A * 9/1925 ..... A41F 15/002
GB 254891 * 7/1926

*Primary Examiner* — Khoa D Huynh
*Assistant Examiner* — Brieanna Szafran
(74) *Attorney, Agent, or Firm* — Brown & Michaels, PC

(57) ABSTRACT

A pin assembly attachment member with a versatile method of use for support and/or enhancement of apparel. This is an improvement upon conventional attachment hooks designed to attach to a single interchangeable and/or convertible garment. Such conventional hooks have somewhat limited utility. The pin assembly attachment member comprises a solid body comprising of at least one aperture for receiving a formed adjustment loop of straps or apparel, and/or an attachment hook, and comprises of an attachment pin having a distal end for puncturing the fabric of apparel for removably engaging with apparel or combination of a garment and/or a bra or other lingerie. The attachment members can be removably secured to an interior portion adjacent to an upper edge of garment using either the attachment hook or the attachment pin. The attachment hook would be inserted through a loop affixed to the garment. The attachment pin would be inserted through an interior lining of the garment. The attachment members can be attached to two garments using the combination of the attachment hook and the attachment pin.

19 Claims, 9 Drawing Sheets

(58) Field of Classification Search
USPC ..... 24/318, 317, 366, 368, 170, 182, 200; 2/73, 107; 450/86, 88
See application file for complete search history.

(56) References Cited

U.S. PATENT DOCUMENTS 1,353,930 A * 9/1920 Merkel ..... A41F 11/12 2/303
1,424,329 A * 8/1922 Walsh ..... A41F 15/002 2/323
1,491,578 A * 4/1924 Ballou ..... A41F 15/002 2/326
1,509,016 A * 9/1924 Mershon, Jr. ..... A41F 15/02 24/363
1,594,051 A * 7/1926 De Mos ..... A41F 15/02 24/353
1,616,267 A * 2/1927 Laird ..... A41F 15/002 2/323
1,660,778 A * 2/1928 Andrew ..... A41F 15/002 2/73
1,677,109 A * 7/1928 Korper ..... A41F 15/02 2/73
1,869,601 A * 8/1932 Martens ..... A41F 15/02 24/706.1
1,886,754 A * 11/1932 Stoffregen ..... A41F 15/02 24/317
1,949,331 A * 2/1934 Richardson ..... A41F 15/02 24/363
1,949,974 A * 3/1934 Nixon ..... A44B 9/12 24/363
2,000,127 A * 5/1935 Desrosiers ..... A41F 15/02 24/363
2,849,723 A * 9/1958 Marino ..... A41F 15/005 2/323
3,179,109 A * 4/1965 Born ..... A41F 1/006 450/83
3,181,214 A * 5/1965 DAmbrosio ..... A44B 9/12 24/364
3,311,112 A * 3/1967 Murray ..... A41F 1/006 450/1
3,982,305 A 9/1976 Meyer
4,038,726 A * 8/1977 Takabayashi ..... A44B 11/06 24/169
5,177,837 A * 1/1993 Rekuc ..... A44B 11/00 24/198
6,179,687 B1 * 1/2001 Lee ..... A41F 1/006 2/67
6,279,171 B1 8/2001 Brancato
D491,101 S * 6/2004 Hsu ..... D11/210
D519,261 S * 4/2006 Reis ..... D11/200
2002/0022434 A1 * 2/2002 Plourde ..... A41F 1/006 450/86
2003/0209034 A1 * 11/2003 Huang ..... A41F 15/002 63/4
2004/0020240 A1 * 2/2004 Brancato ..... A41F 15/002 63/3
2005/0160564 A1 * 7/2005 Hsu ..... A41F 15/002 24/318
2006/0070214 A1 * 4/2006 Hsu ..... A41F 15/002 24/170
2008/0022498 A1 * 1/2008 Griffith ..... F16B 45/02 24/598.7

* cited by examiner

PIN ASSEMBLY ATTACHMENT MEMBER AND VERSATILE METHOD OF USE

CROSS-REFERENCE TO RELATED APPLICATION

This United States National Stage Non-Provisional Patent Application claims the benefit of International Application No. PCT/US2011/051780, filed on 15 Sep. 2011, which in turn claims priority to U.S. Provisional Patent Application Ser. No. 61/403,698, filed on 20 Sep. 2010.

FIELD OF THE INVENTION

The present invention relates generally to a pin assembly attachment member with a versatile method of use for support and/or enhancement of apparel. Apparel, such as shoulder strap tops and/or dresses, and others the like, or strapless garments, such as strapless dresses and tops, which are garments that stay put around the upper body without shoulder straps or other visible means of support. More specifically, the invention pertains to a pin assembly attachment member for apparel including a solid body including at least one aperture for receiving a formed adjustment loop of straps or apparel, and/or an attachment hook, and comprises of an attachment pin having a distal end for puncturing the fabric of apparel for removably engaging with apparel or combination of a garment and/or a bra or other lingerie. The pin assembly attachment member can be part of a bra strap assembly. Bra strap assembly including a strap, an adjustment member and a pair of unitary strap attachment members carried by ends of the strap. The attachment members incorporate a unique combination of an aperture to receive at least one of the first end or the second end of the strap and/or an attachment hook integrally provided as a portion of each respective strap attachment member, and an attachment pin subassembly for facilitating releasable attachment of the strap attachment member to a garment or combination of a garment and a bra or other lingerie.

BACKGROUND OF THE INVENTION

Fashion has many facets including apparel and accessories. Apparel encompasses a wide berth of styles, including formal wear, evening wear, dress wear, casual wear, sports attire, and the like. Styles have different designs for men, women, and children. The broad range of garments enables individuals to personalize their appearance. Accessories expand the offerings for an individual to distinguish their look.

The present invention is particularly well-suited for use with women's wear. Women's wear includes a number of different garment form factors including swimwear, lingerie, evening wear, dress wear, casual wear, sports attire, formal wear, brassieres, and the like. Interchangeable and/or convertible garments are known to include a removable strap having a hook for removably attaching the strap to the garment. The interchangeable and/or convertible garments are known to include a loop manufactured of fabric, roping, ribbon, threading, and the like for receiving the hook. The straps typically included with such garments are generally made of materials specifically suited to match that particular garment. These attachment hooks have somewhat limited utility; that is, such conventional hooks are designed to attach a single interchangeable and/or convertible garment, which is required to include a loop for receiving the hook.

While donning a strapless garment, a wearer may desire to wear a bra underneath the garment. When an individual elects to wear a bra underneath a strapless garment, the bra is preferably also strapless. Oftentimes, bras are worn unsupported on the wearing party in order to maintain the strapless appearance of the cover garment.

Some women are uncomfortable wearing strapless garments, fearing the risk of the garment inadvertently sliding downward. All too often, the top of a strapless garment slides down due to lack of support, requiring the wearer to constantly pull the top of the garment upwards. If the top of a garment slides too far down; the garment may unexpectedly expose a woman's breast, causing great embarrassment.

Well-endowed women, in particular, we typically more comfortable wearing a bra that has adequate support for their busts. However, they often avoid wearing strapless bras since they do not furnish the support provided by straps.

Some garments are only provided in a strapless configuration. This tends to deter women from purchasing the particular style of the garment, based upon the concerns presented above.

When a woman wears an outer garment in combination with an undergarment, such as a bra, it is common to wear either both garments in a strapless configuration or, at least, the undergarment in a strapless configuration. This presents a more desirable appearance by minimizing the visibility of an undergarment.

Accordingly, there is a long-felt, as-of-yet unmet, need for an accessory capable of supporting an upper edge of a strapless garment while simultaneously supporting a strapless undergarment such as a bra. It would be highly desirable to provide such an accessory that also has an aesthetically-pleasing decorative look that enables the wearer to personalize her ensemble.

SUMMARY OF THE INVENTION

The present invention provides a releasably attachable bra strap assembly including a strap having a pair of strap attachment members carried by opposite strap ends. The strap attachment members comprise a combination of an attachment hook and an attachment pin for releasable engagement with a garment or a combination of a garment and an underlying bra.

In a first implementation, a detachable bra strap assembly is provided, comprising:

a strap having a first end and a second end;

a pair of strap attachment members secured to the respective first and second strap ends, each strap attachment member comprising:

a strap attachment member body in the form of a solid planar plate having, on opposite faces thereof, an exposed surface and an attachment surface, the solid planar plate body having a first elongated slot completely bounded by a perimeter edge and a second elongated slot bounded by a partial perimeter edge but having an opening extending through a perimeter edge of the solid planar plate body at one location but terminating short of a second perimeter edge location of the body, both the first and second slots oriented parallel to each other and perpendicular to longitudinal edges of the strap;

an attachment hook portion of the strap solid planar plate attachment member body defined by the elongated second slot; and an attachment pin subassembly attached to the attachment surface of the strap attachment member body of at least one of the strap attachment members, wherein each strap attachment member is carried by a respective one of the first and second strap ends.

In another aspect, the detachable bra strap assembly further comprises a strap adjustment member, enabling a wearer to adjust a length of the strap.

In another aspect, the attachment pin subassembly further comprises an attachment pin pivotally attached to the attachment surface of the strap attachment member body by an attachment pin hinge, and a pin latch for releasably securing the attachment pin in a closed position.

In another aspect, the attachment pin subassembly may be oriented either a parallel or a perpendicular relation to a longitudinal axis of the strap.

In another aspect, the strap may be fabricated of a clear or transparent material. The material is generally clear, transparent, or tinted or clear translucent plastic.

In another aspect, the strap may be fabricated of a decorative material. The decorative material may, for example, be a metallic chain; a woven cording; a metallic cording; a ribbon; a lace, leather, roping, denim or other fabric strip, and the like; or any combination thereof. The base strap material may be ornamentally enhanced with the inclusion of jewels, stones, beading, embroidery, and the like; or any combination thereof.

In another aspect, the strap further comprises a decorative medallion integrated therein.

In another aspect, the exposed surface of the strap attachment member is solid, providing a barrier for the attachment pin subassembly.

In another aspect, the attachment pin subassembly further comprises a pin latch; the pin latch being provided to ensure the attachment pin remains secured while the garment is worn.

A first application of the present invention utilizes a detachable bra strap assembly, for supporting an upper edge of a strapless garment, utilizing a method comprising steps of:

providing a detachable bra strap assembly, comprising: a strap having a first end and a second end;

a pair of strap attachment members attached to the respective first and second strap ends, each strap attachment member including:

a strap attachment member body, the strap attachment member body in the form of a solid planar plate having, on opposite faces thereof, an exposed surface and an attachment surface, the solid planar plate body having a first slot completely bounded by a perimeter edge and a second slot bounded by a partial perimeter edge but having an opening extending through a perimeter edge of the solid planar plate body at one location yet terminating short of a second perimeter edge location of the body, both the first and second slots oriented parallel to each other and perpendicular to longitudinal edges of the strap;

an attachment hook portion of the solid planar plate attachment member defined by the elongated second slot; and an attachment pin subassembly attached to the attachment surface of the strap attachment member body of at least one of the first and second strap ends;

rounded corners; however, as will be apparent to those skilled in the art, strap attachment member body could be provided in any of a myriad of geometries without departing from the intended scope of the invention. The strap attachment member body 132 has, on opposite faces thereof, an attachment surface 136 and an exposed surface 138. A first strap attachment member aperture 134, or slot, is provided extending completely through the strap attachment member body 132 and is preferably oriented parallel to and proximate an upper edge of the strap attachment member body 132. The first strap attachment member aperture 134 is sized and shaped to receive, and reliably retain therethrough, a strap fixed end attachment loop 111. A hook forming body cutout in the form of an elongated slot 152 is provided generally parallel to and proximate a lower edge of the strap attachment member body 132. The elongated slot 152 enters the strap attachment member body 132 from one perimeter side edge and continues toward, but terminates short of, an opposite perimeter side edge, thereby defining an attachment hook 150 proximate to the lower edge of the strap attachment member body 132. The elongated slot 152 also extends through the strap attachment member body 132 through the corresponding attachment and exposed surfaces 136, 138 thereof.

In another aspect, the method further comprises a step of attaching a bra to the strap attachment members.

In another aspect, the method further comprises a step of attaching a bra to the strap attachment members using the attachment hook.

In another aspect, the method further comprises a step of attaching a bra to the strap attachment members using the attachment hook and securing the strap attachment members to a front, upper edge of a upper body garment using the attachment pin subassembly.

In another aspect, the method further comprises a step of arranging the detachable bra strap assembly in a parallel, over the shoulder configuration.

In another aspect, the method further comprises a step of arranging the detachable bra strap assembly in a halter strap configuration.

In another aspect, the method further comprises a step of arranging the detachable bra strap assembly in a cross strap configuration.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Generally, the present invention provides a releasably attachable bra strap assembly including a strap and a pair of strap attachment members carried by respective opposite strap ends. The strap attachment members preferably incorporate a combination of an attachment hook and an attachment pin subassembly for releasable engagement with a strapless garment or a combination of a strapless garment and an underlying bra.

Figure 1:
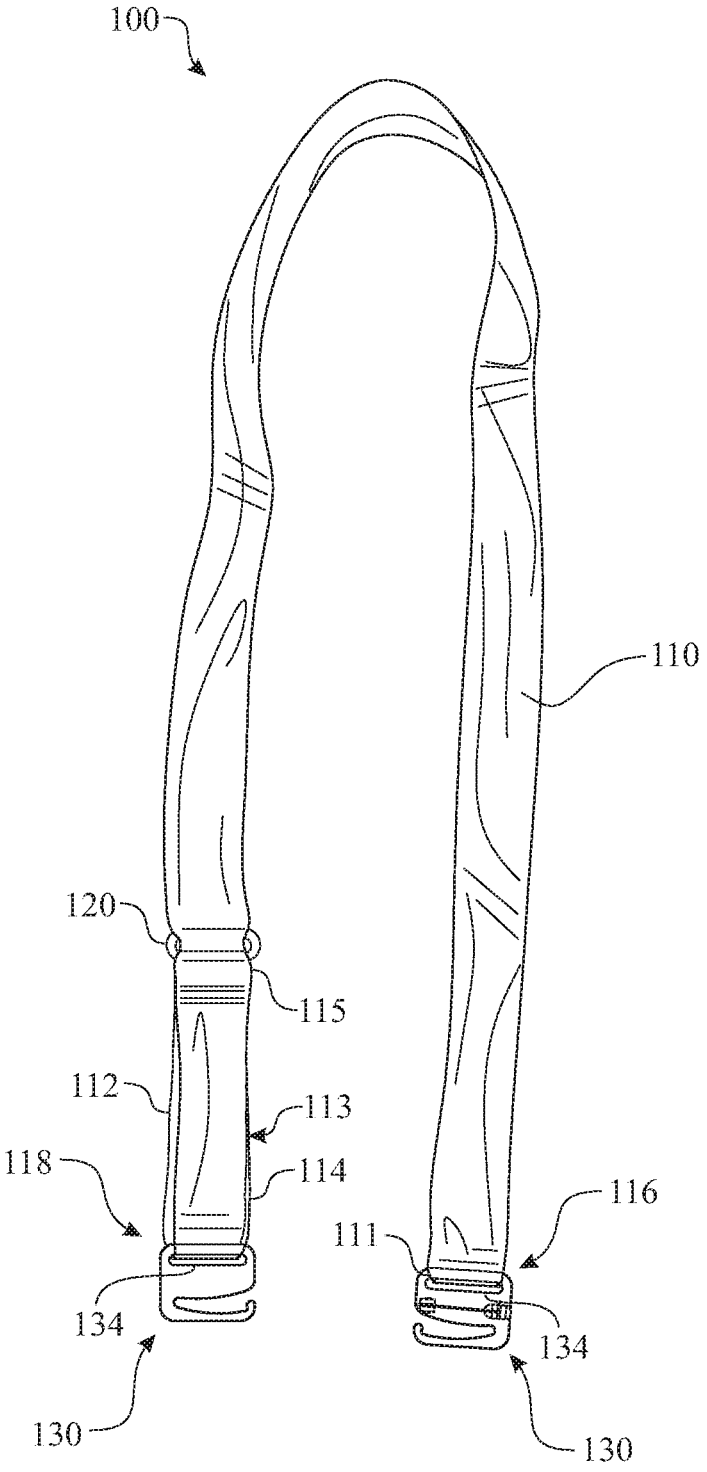
FIG. 1 presents a perspective view of a first exemplary embodiment of a detachable bra strap assembly illustrating a first strap attachment member oriented presenting an exposed side and a second strap attachment member oriented presenting an attachment side.
Figure 2:
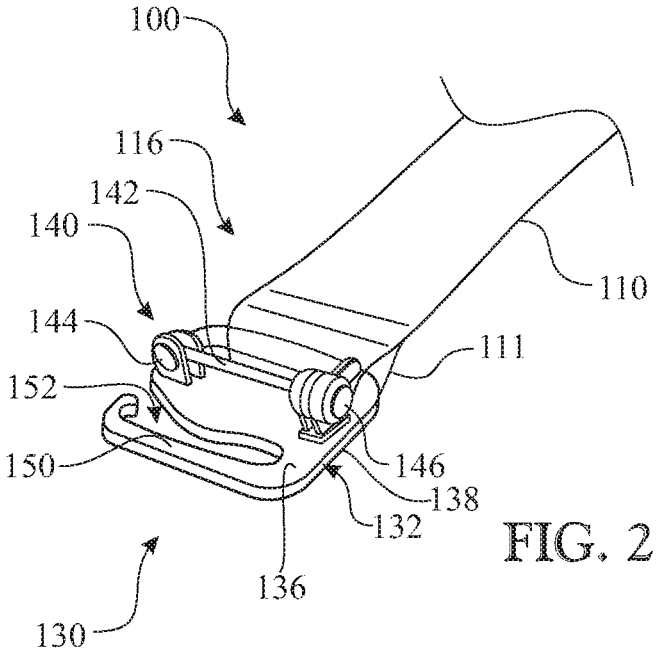
FIG. 2 presents an isometric attachment side view of a first exemplary strap attachment member, the first exemplary strap attachment member illustrated in a closed attachment pin configuration.
Figure 3:
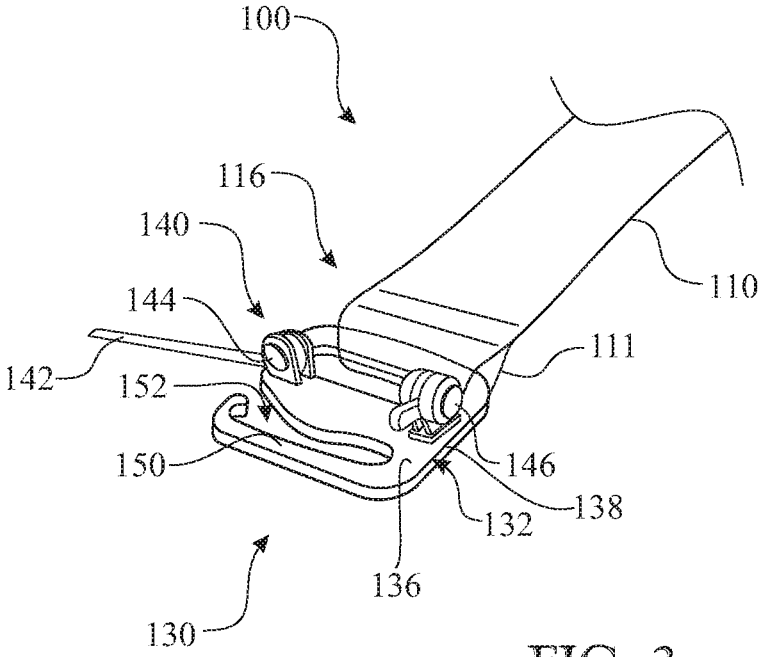
FIG. 3 presents an isometric attachment side view of the first exemplary strap attachment member, the first exemplary strap attachment member illustrated in an opened attachment pin configuration.

Referring initially to FIGS. 1-3, a first exemplary implementation of the present invention is referred to as a detachable, or releasably attachable, bra strap assembly 100. The detachable bra strap assembly 100 incorporates a bra strap 110. The bra strap 110 is preferably fabricated of a transparent material, such as plastic, nylon, and the like. However, as will be apparent to those skilled in the art, the bra strap 110 can alternatively be fabricated of an opaque material, such as a woven fabric, canvas, leather, ribbon, plastic, and the like.

The detachable bra strap assembly 100 may have a pair of strap attachment members 130 secured at opposite ends of strap length 110. Each strap attachment member 130 includes a strap attachment member body 132, wherein the strap attachment member body 132 is preferably fabricated of a sheet of metal, plastic or other rigid material, in the form of a unitary planar plate. The strap attachment member body 132 can be formed using a molding process, a casting process, a stamping process, a machining process or any other forming process. In the exemplary implementation, the strap attachment member body 132 is provided having a generally planar rectangular shape, optionally having commonly known latching mechanism, including a rotational latch as illustrated. It is noted that the attachment pin subassembly 140 is perpendicular to the general longitudinal axis formed by the bra strap 110. However, the attachment pin subassembly may be provided parallel to the general longitudinal axis of the bra strap 110, without departing from the intended scope of the invention. Any tension applied, by the bra strap 110 onto the pin, is distributed across the pin-to-fabric interface.

An attachment pin subassembly 140 is assembled to the attachment surface 136 of the strap attachment member body 132. The first exemplary implementation orients the attachment pin subassembly 140 parallel to the attachment hook 150 created by the elongated slot 152. The exemplary attachment pin subassembly 140 includes an attachment pin 142 rotationally, or rotatably, attached to the strap attachment member body 132 via attachment pin hinge 144. A pin latch 146 is located to selectively receive and retain the attachment pin 142 therein when the attachment pin 142 is placed into a closed and secured configuration, as best illustrated in FIG. 2. It is understood that the attachment pin subassembly 140 can be of any form factor, including a spring mounted pin and a fixed loop forming a pin latch. The user would release the attachment pin 142 by operating the pin latch 146 accordingly, and then rotate the attachment pin 142 about the attachment pin hinge 144 into an open, insertion configuration, as best illustrated in FIG. 3. The pin latch 146 can include any wherein each strap attachment member is carried by a respective one of the first and second strap ends.

attaching, to the upper edge of the strapless garment, at least one of the attachment hook to a loop carried by a garment, the loop being located proximate an upper edge of the garment, and the attachment pin to an interior surface of the upper edge of the strapless garment.

A first strap attachment member 130 is carried by a strap fixed end attachment loop 111 formed at a strap fixed end 116 of the bra strap 110. An end of the bra strap 110 is threaded through the strap attachment member aperture 134 of the first strap attachment member 130, and subsequently looped back to a section of the bra strap 110 and attached thereto, forming the strap fixed end attachment loop 111. A second strap attachment member 130 is carried by a loop 113 formed by a first adjustable strap segment 112 and a second adjustable strap length 114 defining a strap adjustment end 118 of the bra strap 110. The loop 113 formed by the first adjustable strap length 112 and the second adjustable strap length 114 is threaded through the strap attachment member aperture 134 of the second strap attachment member 130. The strap adjustment end 118 of the bra strap 110 is configured by passing, or inserting, it through a strap adjustment member 120, and subsequently through the strap attachment member aperture 134 of the second strap attachment member 130, thereby creating the first adjustable strap portion, or length 112 therebetween. The strap adjustment end 118 is then extended toward the strap adjustment member 120 so as to define the second adjustable strap portion, or length 114 therebetween. The end of the bra strap 110 is attached to the strap adjustment member 120 by a strap adjustment end attachment loop 115.

Applications of the detachable bra strap assembly 100 will be further described hereinbelow.

Figure 4:
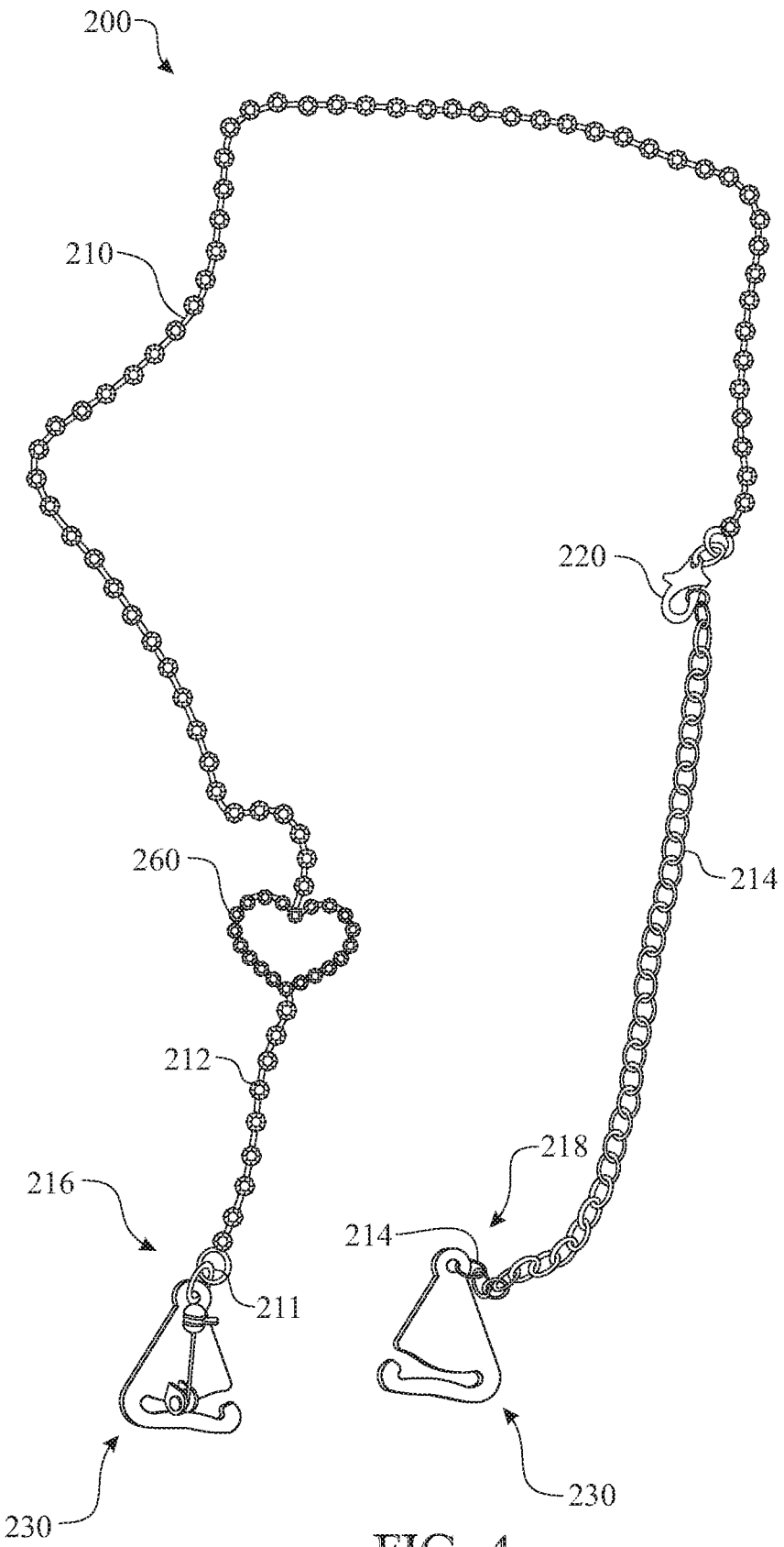
FIG. 4 presents a perspective view of a second exemplary embodiment of a detachable bra strap assembly incorporating a second exemplary strap attachment member.
Figure 5:
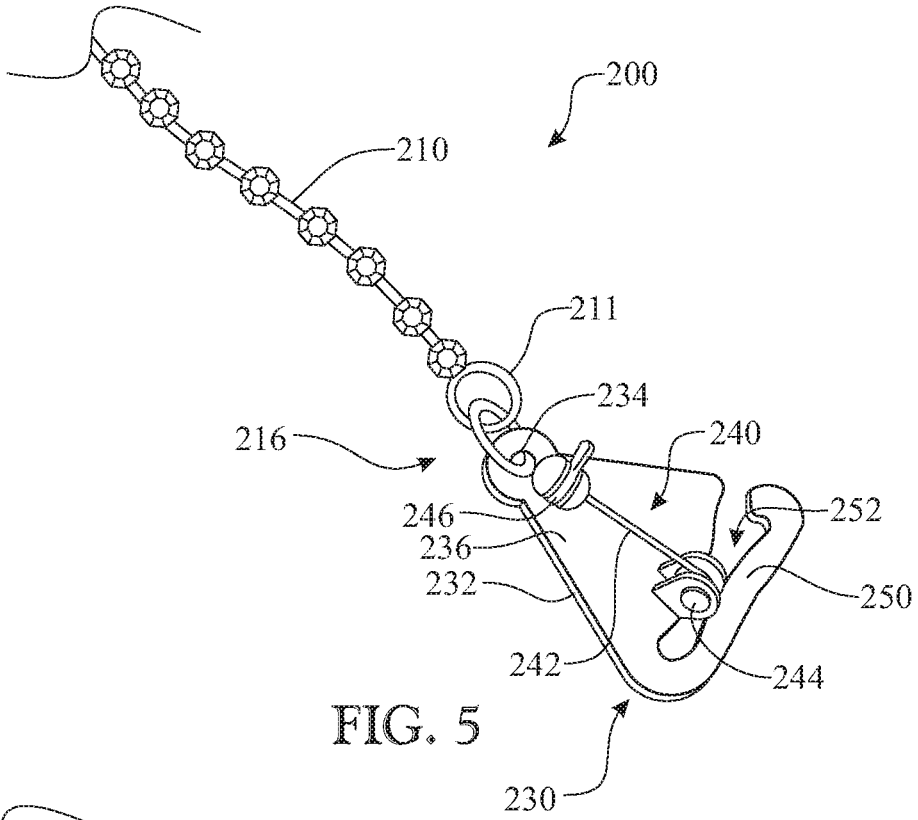
FIG. 5 presents an isometric attachment side view of the second exemplary strap attachment member, the second exemplary strap attachment member illustrated in a closed attachment pin configuration.
Figure 6:
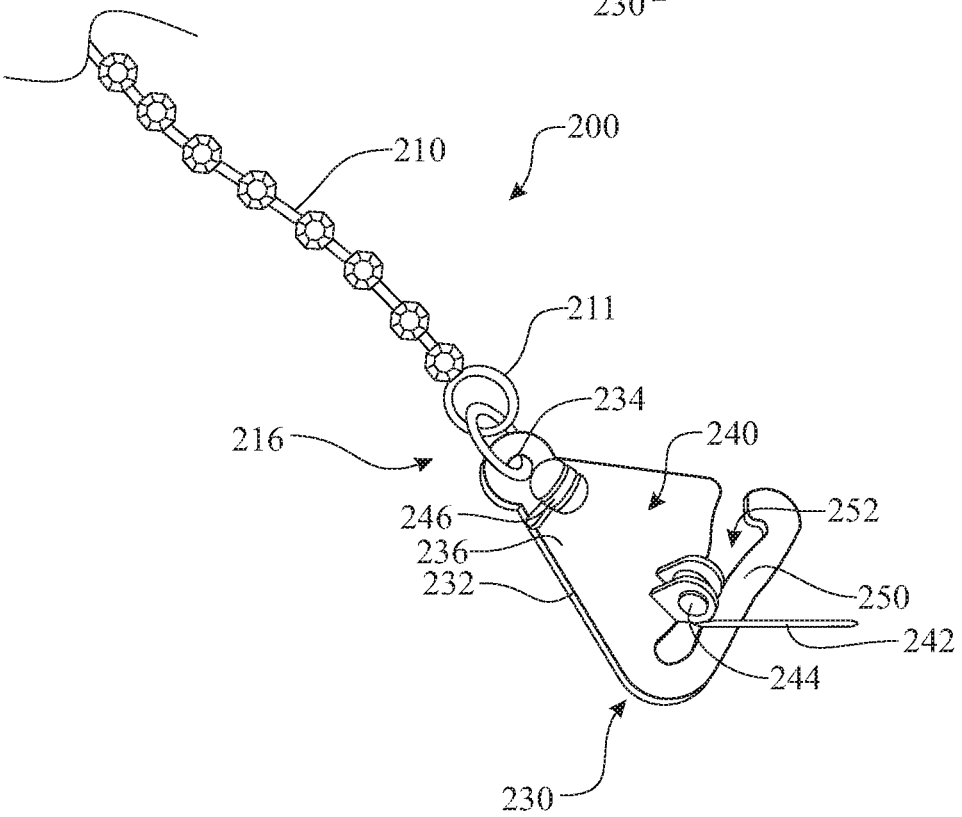
FIG. 6 presents an isometric attachment side view of the second exemplary strap attachment member, the second exemplary strap attachment member illustrated in an opened attachment pin configuration.

Referring now particularly to FIGS. 4-6, in a second exemplary implementation of the present invention a detachable bra strap assembly 200 is shown, with exemplary applications of the detachable bra strap assembly 200 best illustrated in FIGS. 7-14. Like features of detachable bra strap assembly 200 and detachable bra strap assembly 100 are numbered the same except that the elements of detachable bra strap assembly 200 are preceded by the numeral "2." The detachable bra strap assembly 200 includes a bra strap 210, wherein the exemplary bra strap 210 is shown fabricated in the form of an ornamental linked chain. The exemplary implementation further includes a plurality of rhinestones 212 carried by the ornamental linked chain 210. It is understood that the ornamental linked chain can carry any of a variety of adorning or aesthetically pleasing items, including jewels, stones, beading, and the like. The detachable bra strap assembly 200 also includes a pair of strap attachment members 230 secured at a strap fixed end 216 and an opposite strap adjustment end 218, respectively, of the bra strap 210.

The exemplary implementation is additionally enhanced by integrating a decorative medallion 260 with the bra strap 210. The decorative medallion 260 is included in the aforementioned group of adorning or aesthetically pleasing items. The decorative medallion 260 may take the form of, for example, any solid or peripheral geometric configuration. Again, the decorative medallion 260 may take on any geometric shape, a freeform shape, and the like. The decorative medallion 260 may, in addition to being formed into a geometric shape, be shaped, and incorporate printing representing a likeness of a character, an individual, a phrase, an object, and the like.

Each strap attachment member 230 includes a strap attachment member body 232, wherein the strap attachment member body 232 is preferably of a generally triangular shape having rounded corners. The strap attachment member body 232 is preferably symmetric, having a corner oriented at a top and a lower peripheral side horizontally disposed and located at a bottom thereof. The strap attachment member body 232 has, on opposite faces thereof, an attachment surface 236 and a respective exposed surface 238. A strap attachment member assembly aperture 234 is provided extending completely through the strap attachment member body 232, with the strap attachment member assembly aperture 234 preferably having a circular geometry and located proximate an upper edge of the strap attachment member body 232. The strap attachment member assembly aperture 234 is sized and shaped to receive and reliably retain therethrough a strap fixed end attachment loop 211, wherein the strap fixed end attachment loop 211 may comprise any loop configuration. A hook forming body cutout in the form of an elongated slot 252 is provided generally parallel to, and proximate to, a lower edge of the strap attachment member body 232. The elongated slot 252 begins at one peripheral side edge of the strap attachment member body 232, and continues in a direction toward, but terminating short of, an opposite peripheral side edge of strap attachment member body 232, so as to create an attachment hook 250 proximate to the lower edge of the strap attachment member body 232. The elongated slot 252 also extends completely through the strap attachment member body 232.

An attachment pin subassembly 240 is assembled to the attachment surface 236 of the strap attachment member body 232. This second exemplary implementation orients the attachment pin subassembly 240 perpendicular to the attachment hook 250 created by the hook forming body cutout 252, which is also parallel to the general longitudinal axis of the bra strap 210. The attachment pin subassembly 240 is shown in a closed position in FIG. 5, and in an open position in FIG. 6. The attachment pin subassembly 240 includes an attachment pin 242, an attachment pin hinge 244, and an attachment pin latch 246. The attachment pin hinge 244 is fixedly attached upon, and projects outwardly from, the attachment surface 236 of the strap attachment member body 232. The attachment pin 242 is provided having one end mounted upon the attachment surface 236 of attachment member body 232 via attachment pin hinge 244, such that the attachment pin 242 may undergo pivotal movement toward and away from the attachment surface 236. The attachment pin latch 246 is spaced apart from the attachment pin hinge 244 at a distance that is approximately the length of the attachment pin 242, and the attachment pin latch is fixedly attached upon, and projects outwardly from, the attachment surface 236 of the strap attachment member body 232. The attachment pin latch 246 is thus located to selectively receive and retain the attachment pin 242 when the attachment pin is biased into the closed and secured configuration illustrated in FIG. 5. It will be apparent to those skilled in the art that the attachment pin subassembly 240, as mentioned previously hereinabove, with respect to the attachment pin subassembly 140, that attachment pin subassembly 240 may incorporate any form factor, including a spring mounted pin and a fixed loop pin latch.

The dual attachment configuration, comprising the attachment pin subassembly 240 and the attachment hook 250, enables the wearer to utilize the detachable bra strap assembly 200 in a variety of applications. The applications of the detachable bra strap assembly 100, 200 can be considered in two functions: (1) the attachment to the garment and (2) the configuration of the strap portion 110, 210 of the detachable bra strap assembly 100, 200.

Figure 7:
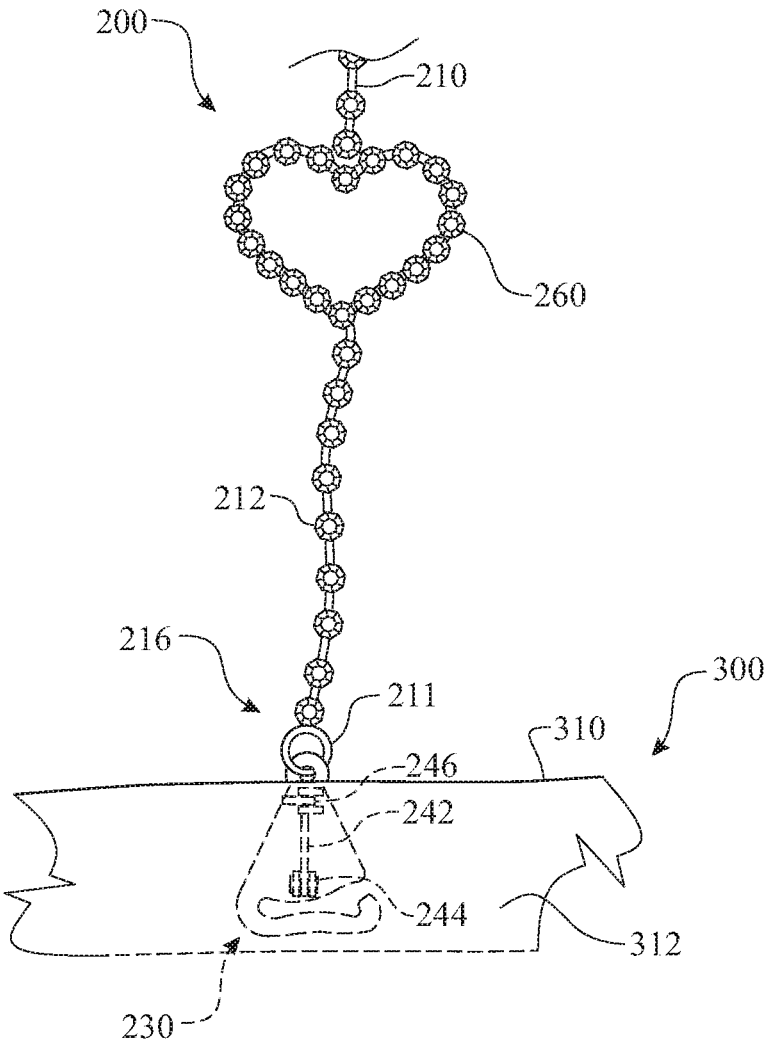
FIG. 7 presents a front view of the second exemplary strap attachment member attached to an upper edge of an exemplary outerwear garment.
Figure 8:
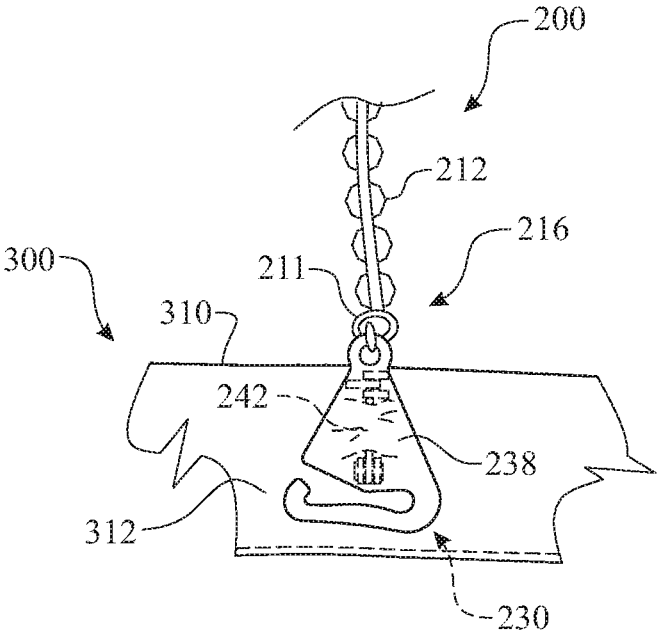
FIG. 8 presents a rear view of the second exemplary strap attachment member attached to the upper edge of the garment.

Significantly, the strap attachment member 230 can be selectively attached to an upper edge 310 of a strapless upper body garment 300 using either the attachment pin subassembly 240 or the attachment hook 250. The strapless upper body garment 300 is fabricated having a garment upper liner element 312 located upon an inner portion of the strapless upper body garment 300, proximate to the garment upper edge 310. Referring now particularly to FIGS. 7 and 8, in the exemplary implementations, presenting a front view in FIG. 7 and a rear view in FIG. 8, the attachment pin 242 is released from the pin latch 246 and subsequently inserted through the garment upper liner element 312 of the garment upper edge 310. The attachment pin 242 is subsequently rotated about attachment pin hinge 244 and secured, in a closed configuration, by pin latch 246. Significantly, in this closed configuration, the strap attachment member 230 remains hidden from plain view while the strapless upper body garment 300 is being worn, as best illustrated by the front view shown in FIG. 7. The location of the strap attachment member 230 can be selectively adjusted by the wearer to suit the wearer's desired degree of exposure thereof. The exposed, or outwardly-facing, contiguous planar surface 238 of the strap attachment member 230 protects, and provides comfort to, the wearer.

Figure 9:
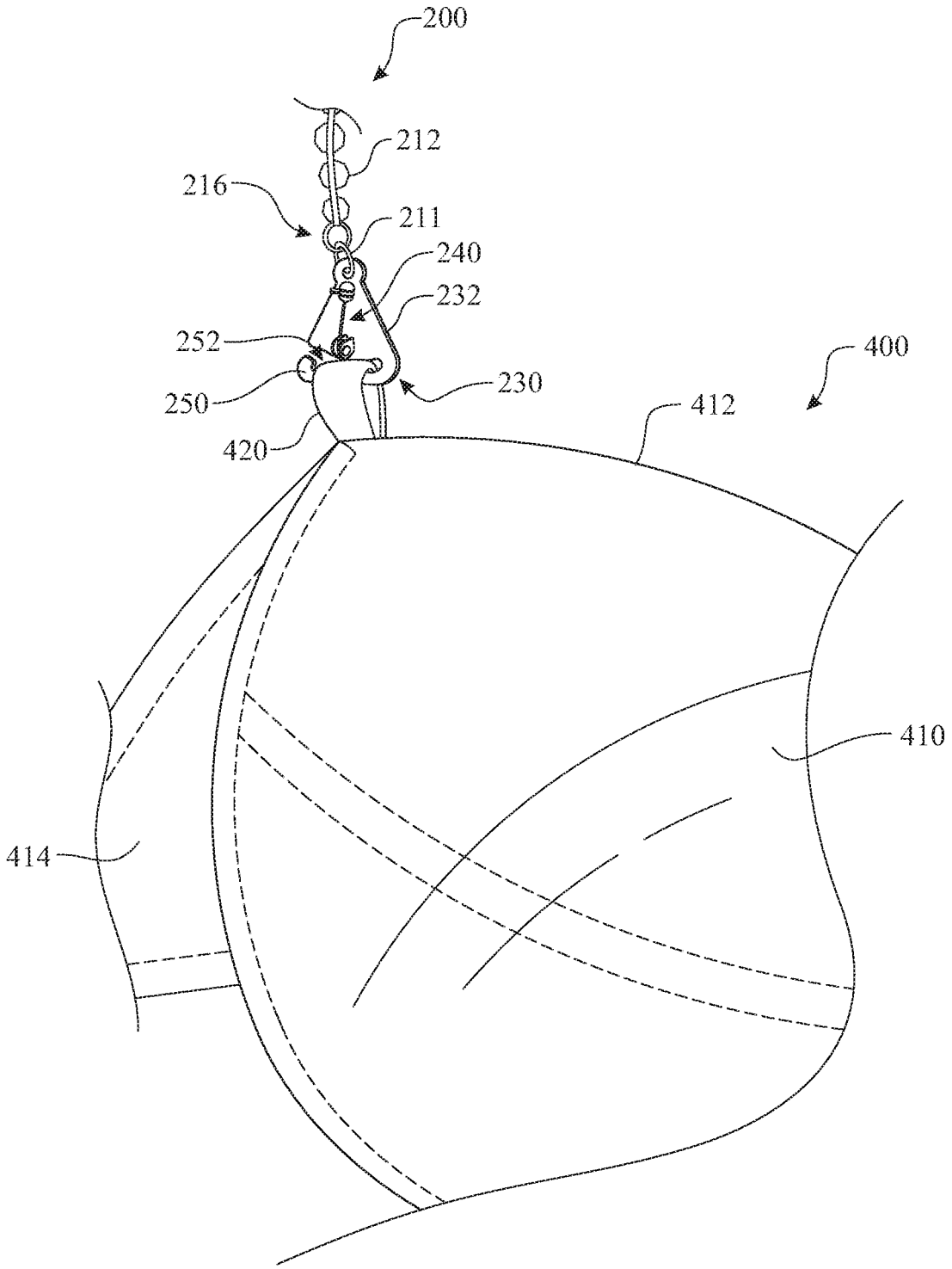
FIG. 9 presents a rear view of the second exemplary strap attachment member attached to the upper edge of an exemplary underwear garment, more specifically a bra.

The strap attachment member 230 can be attached to a garment, such as a bra 400, using a combination of the attachment hook 250 and a support loop 420, as presented in the exemplary illustration of FIG. 9. The bra 400 includes a bra cup 410 having a bra upper edge 412. A bra strap 414 extends from a side edge of the bra cup 410 to create a tubular shaped garment, which is wrapped about an individual's upper torso. A support loop 420 is attached to the bra cup 410 or bra strap 414, the support loop 420 being located proximate the bra upper edge 412. The attachment hook 250 is inserted through the support loop 420 to support the bra 400 when worn. The strap attachment member 230 can be exposed or remain hidden, based upon the location of the support loop 420, when the bra 400 is worn.

Figure 10:
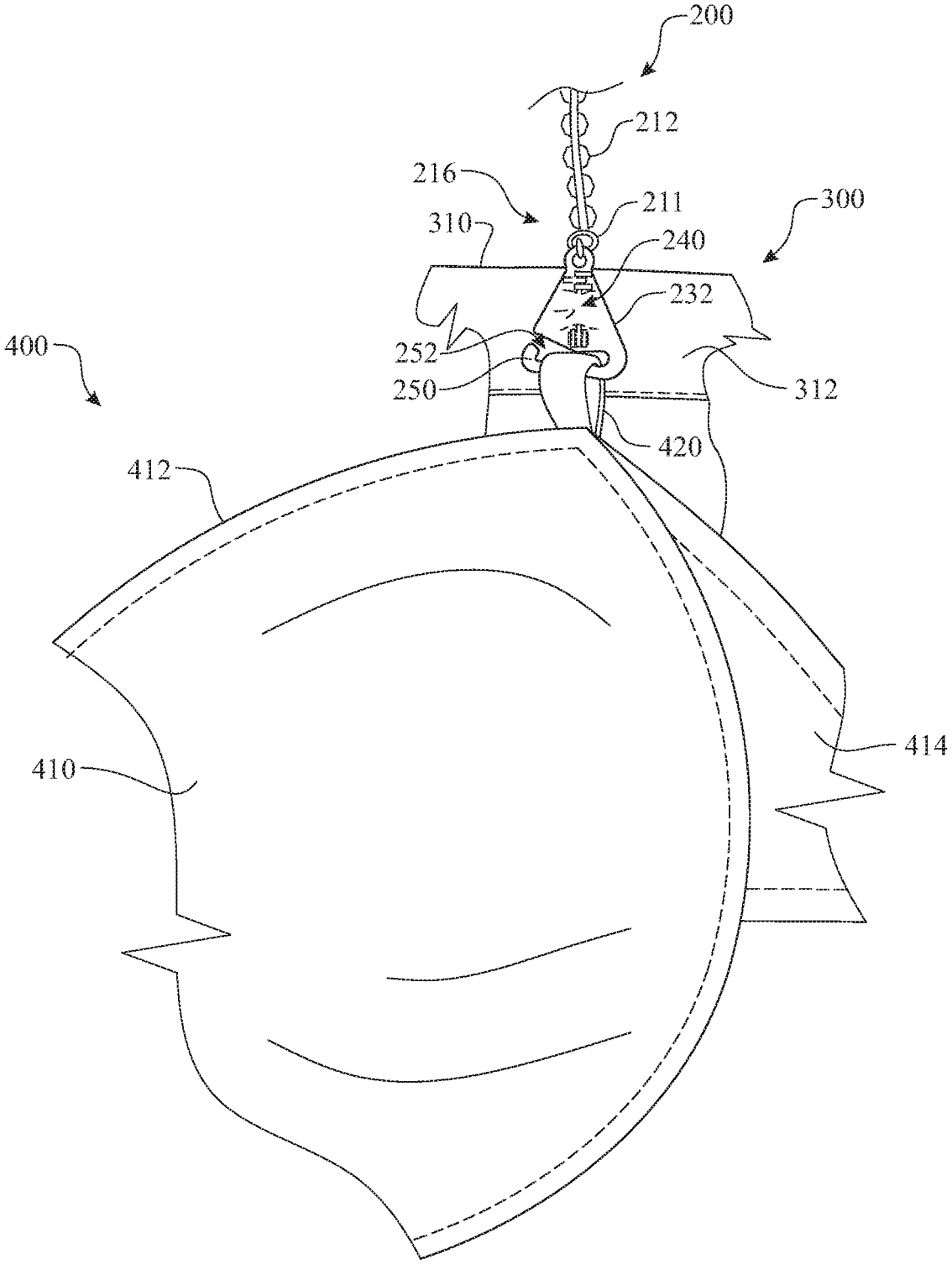
FIG. 10 presents a rear view of the second exemplary strap attachment member attached to the upper edge of the outerwear garment via the attachment pin subassembly and the underwear garment via the attachment hook.

The combination of the attachment pin subassembly 240 and the attachment hook 250 enables the strap attachment member 230 to attach to a pair of garments as illustrated in FIG. 10. The attachment pin subassembly 240 is attached to an interior surface of the strapless upper body garment 300 and the attachment hook 250 is inserted through the support loop 420 of the bra 400. This configuration provides support to both the strapless upper body garment 300 and bra 400, as well as temporarily joining the strapless upper body garment 300 and bra 400 together.

The above described variations for attaching the detachable bra strap assembly 100, 200 to one or a pair of garments. A second consideration is the configuration for wearing the detachable bra strap assembly 100, 200. Several exemplary configurations are presented in FIGS. 11 through 14. A strapless dress 510 adorns an individual 500 in FIGS. 11 and 12. The strapless dress 510 includes a dress bodice 512 having a dress upper edge 514.

Figure 11:
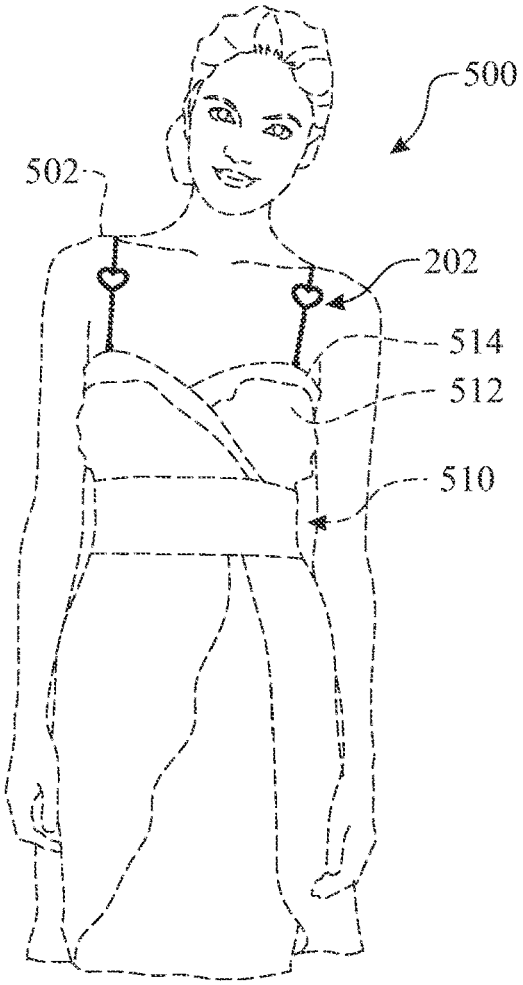
FIG. 11 presents a front view of an individual utilizing a pair of detachable bra strap assemblies to support an exemplary outerwear garment such as a dress, the detachable bra strap assemblies arranged in a parallel, over the shoulder configuration.

In a parallel, over the shoulder configuration 202, a pair of detachable bra strap assemblies 200 is worn, being placed over a shoulder 502 of the individual 500, as illustrated in FIG. 11. The pair of detachable bra strap assemblies 200 is attached to a front portion of the dress bodice 512 using the first strap attachment member 230 and a rear portion of the dress bodice 512 using the second strap attachment member 230. The detachable bra strap assembly 200 is oriented with the adjustable portion towards the rear of the strapless dress 510.

Figure 12:
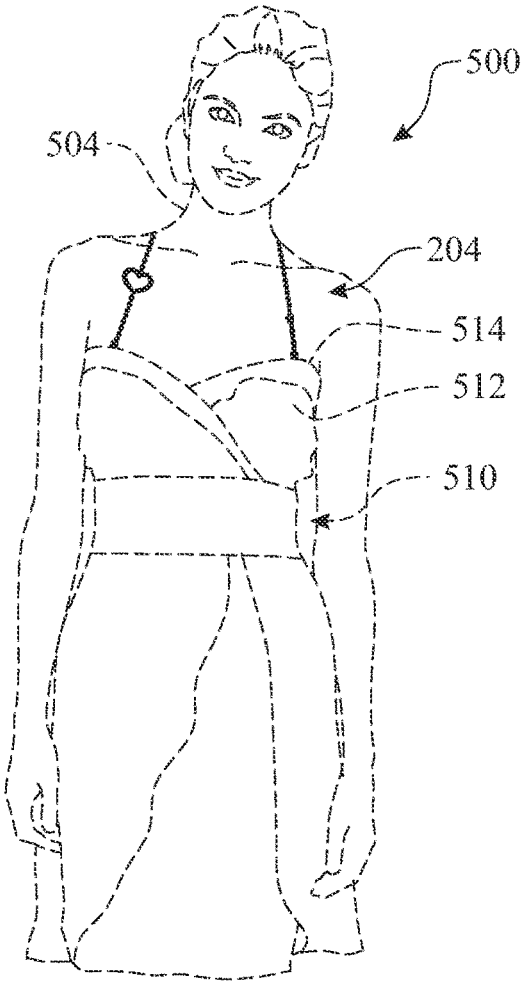
FIG. 12 presents a front view of an individual utilizing a single of detachable bra strap assembly to support an exemplary outerwear garment such as a dress, the detachable bra strap assembly arranged in a halter strap configuration.

In a halter strap configuration 204, the detachable bra strap assembly 200 is worn, being placed about a neck 504 of the individual 500, as illustrated in FIG. 12. A single detachable bra strap assembly 200 is attached to a left side, front portion of the dress bodice 512 using the first strap attachment member 230 and a right side, front portion of the dress bodice 512 using the second strap attachment member 230.

Figure 13:
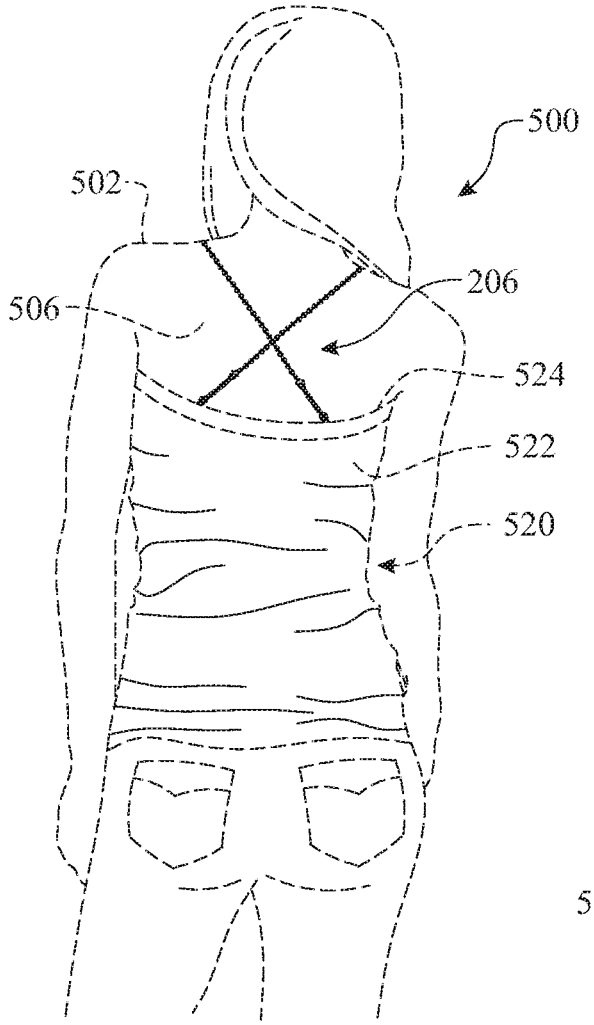
FIG. 13 presents a rear view of an individual utilizing a pair of detachable bra strap assemblies to support an exemplary outerwear garment such as a tube top, the detachable bra strap assemblies arranged in a cross strap configuration.

A tube top 520 adorns an individual 500 in FIG. 13. The tube top 520 includes a tube top body 522 having a top upper edge 524. In a cross strap configuration 206, a pair of detachable bra strap assemblies 200 is worn, being placed over a shoulder 502 and oriented crossing one another along a back 506, as illustrated in FIG. 13. The first strap attachment member 230 of a first detachable bra strap assembly 200 is attached to a left side, front portion of the tube top body 522 and the second strap attachment member 230 of a first detachable bra strap assembly 200 is attached to a right side, rear portion of the tube top body 522. The first strap attachment member 230 of a second detachable bra strap assembly 200 is attached to a right side, front portion of the tube top body 522 and the second strap attachment member 230 of a second detachable bra strap assembly 200 is attached to a left side, rear portion of the tube top body 522. Each detachable bra strap assembly 200 is oriented with the adjustable portion towards the rear of the tube top 520. This configuration crosses the first detachable bra strap assembly 200 and the second detachable bra strap assembly 200. The crossover section is preferably located proximate a back 506.

Figure 14:
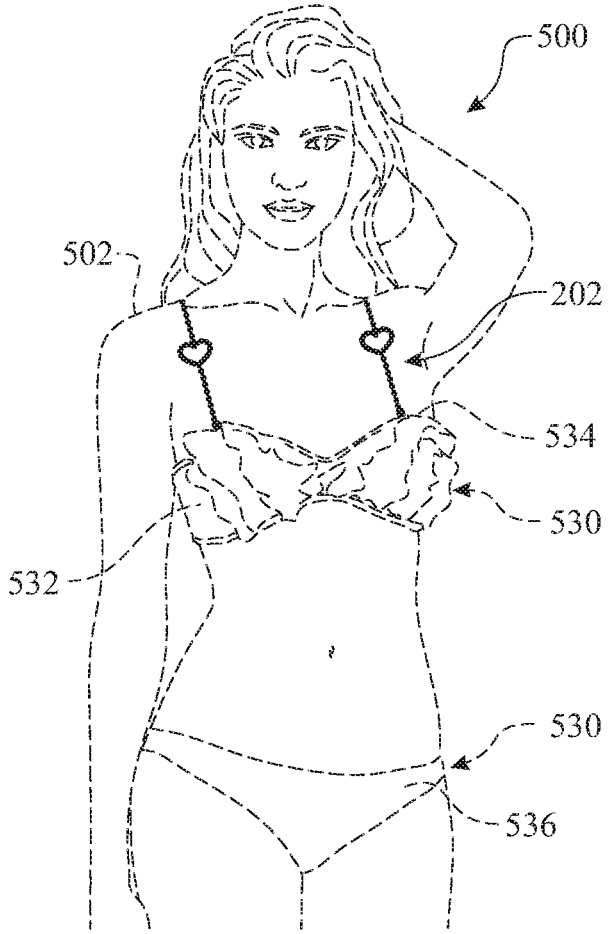
FIG. 14 presents a front view of an individual utilizing a pair of detachable bra strap assemblies to support an exemplary swimwear garment such as a bikini, the detachable bra strap assemblies arranged in a parallel, over the shoulder configuration.

Bathing attire 530 adorns an individual 500 in FIG. 14. The bathing attire 530 includes a bikini top 532 having a top upper edge 534 and a bikini bottom 536. The bikini top 532 can be adorned and supported by one or a pair of detachable bra strap assembly 200 in any configuration. The detachable bra strap assemblies 200 are shown in a parallel, over the shoulder configuration 202 in the exemplary illustration presented in FIG. 14.

In any configuration, the individual can adjust an overall length of each detachable bra strap assembly 100, detachable bra strap assembly 200 using the strap adjustment member 120, strap adjustment member 220 respectively. In the exemplary embodiment, the strap adjustment member 220 is a lobster claw styled clip, which engages along any length of an adjustable strap segment 214. The adjustment is accomplished in accordance with the style of adjusting mechanism utilized by the manufacturer. It is understood that the strap adjustment member 120, 220 can be of any form factor known by those skilled in the art, while taking considerations to the material selected for the bra strap 110, 210.

Garments may include straps where the individual may desire to modify the intended configuration of the garment by either removing the straps, or folding and inserting the straps within the upper section. The individual would then attach the detachable bra strap assembly 100, 200 as described above to ornate the garment.

Alternatively, the bra strap 110, bra strap 210 can be fabricated of any material including a metallic chain; a woven cording; a metallic cording; a ribbon; a lace, leather, roping, denim or other fabric strips, and the like; or any combination thereof. The base strap material bra strap 110, 210 can be enhanced with the inclusion of jewels, stones, beading, embroidery, and the like; or any combination thereof.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A detachable bra strap assembly for apparel comprising fabric, the detachable bra strap assembly comprising:

a strap having a first end and a second end;

a strap adjustment member integrated with said strap, said strap adjustment member enabling adjustment of a length of said strap;

a pair of strap attachment members attached to the respective first and second ends of said strap, each strap attachment member including:

a strap attachment member body in the form of a solid planar plate having a first strap attachment member aperture provided within an interior area of said solid planar plate such that the first strap attachment member aperture is completely bounded by a first aperture perimeter edge, the solid planar plate having a second strap attachment member aperture extending into the interior area of said solid planar plate from a perimeter edge thereof, such that the second strap attachment member aperture is partially bounded by a second aperture perimeter edge but has an opening extending into the interior area of the solid planar plate from a first location along the peripheral edge of the solid planar plate, the opening extending completely through the solid planar plate in a direction toward but terminating short of an opposite second location along the peripheral edge of the solid planar plate;

an attachment hook integrally formed as part of said strap attachment member body said attachment hook created by the formation of said second strap attachment member aperture; and an attachment pin subassembly attached between the first strap attachment member aperture and the second strap attachment member aperture to an attachment surface of said strap attachment member body, said attachment pin subassembly including a pin secured to the attachment surface by a pin subassembly hinge and a pin latch, such that the pin is raised above and extends parallel to the attachment surface of the strap attachment member body and the pin subassembly hinge and the pin latch are mounted perpendicular to the attachment surface enabling the pin to be raised above the attachment surface such that the rotation of the attachment pin pivots from the pivot hinge location when the pin is removed from the pin latch;

wherein, each strap attachment member is carried by a respective one of said first and second ends of said strap.

2. The detachable bra strap assembly as recited in claim 1, wherein said strap is configured with the length of said strap passing through one of the first and second strap attachment member apertures, at least one of said first and second ends of said strap being secured to said strap adjustment member such that an adjustment loop is formed and one of said strap attachment members is carried by said adjustment loop.

3. The detachable bra strap assembly as recited in claim 1, wherein, said pin latch is configured for releasably securing a distal end of said pin thereto and wherein the distal end of the pin punctures the fabric of the apparel.

4. The detachable bra strap assembly as recited in claim 1, wherein said length of said strap is provided carrying at least one decorative adorning element.

5. The detachable bra strap assembly of claim 1, wherein the apparel is selected from the group consisting of swimwear, lingerie, evening wear, dress wear, casual wear, sports attire, formal wear, and brassieres.

6. The detachable bra strap assembly of claim 1, wherein the strap is fabricated of a material selected from the group consisting of: a decorative material, a clear material, a transparent material, a clear translucent plastic, and a tinted material.

7. A strap attachment member adapted for attachment to a strap length for use with fabric of apparel, the strap attachment member comprising:

a strap attachment member body in the form of a solid planar plate having a first strap attachment member aperture provided within an interior area of said solid planar plate, such that the first strap attachment member aperture is completely bounded by a first aperture perimeter edge, the solid planar plate having a second strap attachment member aperture extending into the interior area of said solid planar plate from a perimeter edge thereof: such that the second strap attachment member aperture is partially bounded by a second aperture perimeter edge but has an opening extending into the interior area of the solid planar plate from a first location along a peripheral edge of the solid planar plate, the opening extending completely through the solid planar plate in a direction toward, but terminating short of, an opposite second location along the peripheral edge of the solid planar plate; and an attachment pin subassembly attached between the first strap attachment member aperture and the second strap attachment member aperture to an attachment surface of said strap attachment member body, said attachment pin subassembly including a pin having a distal end for puncturing the fabric of the apparel, the pin being secured to the attachment surface by a pin subassembly hinge and a pin latch for releasably securing the distal end of the pin, such that the pin is raised above and extends parallel to the attachment surface of the strap attachment member body, and the pin subassembly hinge and the pin latch are mounted perpendicular to the attachment surface enabling the pin to be raised above the attachment surface such that the rotation of the pin pivots from a location of the pin subassembly hinge when the distal end of the pin is released from the pin latch.

8. The strap attachment member of claim 7, further comprising an attachment hook integrally formed as part of said strap attachment member body, said attachment hook created by the formation of said second strap attachment member aperture.

9. The strap attachment member of claim 7, wherein the apparel is selected from the group consisting of swimwear, lingerie, evening wear, dress wear, casual wear, sports attire, formal wear, and brassieres.

10. An attachment member for apparel comprising fabric, the attachment member comprising:

a solid body comprising:

an aperture provided within an interior area of the solid body, such that the aperture is completely bounded by a first perimeter edge of the solid body;

a cutout formed parallel to and proximate to the aperture within the interior area of the solid body, the cutout being partially bounded by a second perimeter edge, opposite the first perimeter edge, of the solid body from a first location along a peripheral edge of the solid body, the cutout extending completely through the solid body in a direction toward, but terminating short of, an opposite second location along the peripheral edge of the solid body;

an attachment pin assembly comprising a spring mounted pin attached to an attachment surface of the solid body and a pin latch, wherein the spring mounted pin has a distal end which punctures fabric of the apparel and the pin latch releasably secures the distal end of the spring mounted pin, such that the spring mounted pin is raised above the solid body between the aperture and the cutout when the distal end of the spring mounted pin is released from the pin latch.

11. The attachment member of claim 10, further comprising a strap having a first end and a second end, wherein at least one of the first end or the second end of the strap is received within the aperture of the solid body of the attachment member.

12. The attachment member of claim 11, wherein the strap further comprises at least one decorative adorning element.

13. The attachment member of claim 11, wherein the strap is configured with a length of the strap passing through the aperture of the solid body, at least one of the first end or the second end of the strap being secured to the attachment member such that an adjustment loop is formed and the attachment member is carried by the adjustment loop.

14. The attachment member of claim 11, wherein the strap is fabricated of a material selected from the group consisting of: a decorative material, a clear material, a transparent material, a clear translucent plastic, and a tinted material.

15. The attachment member of claim 10, wherein the apparel is selected from the group consisting of swimwear, lingerie, evening wear, dress wear, casual wear, sports attire, formal wear, and brassieres.

16. The attachment member of claim 10, wherein the spring mounted pin and the pin latch are parallel to the aperture.

17. The attachment member of claim 10, further comprising at least one strap having a first end and a second end, wherein at least one of the first end or the second end of the at least one strap is received within the aperture of the solid body of the attachment member, such that the at least one strap is added to the apparel.

18. The attachment member of claim 10, further comprising an attachment hook integrally formed as part of the solid body, the attachment hook created by the formation of the cutout.

19. The attachment member of claim 10, wherein the spring mounted pin and the pin latch are mounted perpendicular to the solid body.

* * * * *